US005371938A

United States Patent [19]

Martin

[11] Patent Number: 5,371,938

[45] Date of Patent: Dec. 13, 1994

[54] MACHINE FOR CUTTING AND REMOVING THE WRAPPER OF A BALE

[75] Inventor: Mario Martin, Treviso, Italy

[73] Assignee: Comas S.P.A., Silea, Italy

[21] Appl. No.: 170,417

[22] Filed: Dec. 20, 1993

[30] Foreign Application Priority Data

Dec. 24, 1992 [IT] Italy ..... TO92 A 001040

[51] Int. Cl.[5] ..... B23P 19/00; B65B 69/00; B65G 65/02

[52] U.S. Cl. ..... 29/564.3; 83/909; 83/923; 414/412

[58] Field of Search ..... 29/564.3, 56.5, 426.4, 29/426.3; 83/586, 909, 923; 414/412

[56] References Cited

U.S. PATENT DOCUMENTS 4,592,698 6/1986 Semp et al. ..... 29/564.3 X
4,838,751 6/1989 Hanaya et al. ..... 414/412
4,929,141 5/1990 Keesey ..... 83/909 X
5,179,878 1/1993 Kranefeld et al. ..... 29/564.3 X
5,199,841 4/1993 Von Gehlen ..... 83/909 X
5,297,329 3/1994 Santin et al. ..... 29/564.3

*Primary Examiner*—William Briggs
*Attorney, Agent, or Firm*—Edward D. Manzo

[57] ABSTRACT

The machine comprises a support structure including a vertical upright, a cross member which can move vertically along the upright, two horizontal arms, one end of each being articulated to the cross member and the other end having a rotatable gripping device for gripping a bale, motor means and associated control devices for moving the cross member, for moving the arms apart and towards each other and for rotating their gripping devices, and a cutting device for cutting the wrapper of a bale which is gripped and rotated by the gripping devices of said arms.

8 Claims, 9 Drawing Sheets

Figure 1:
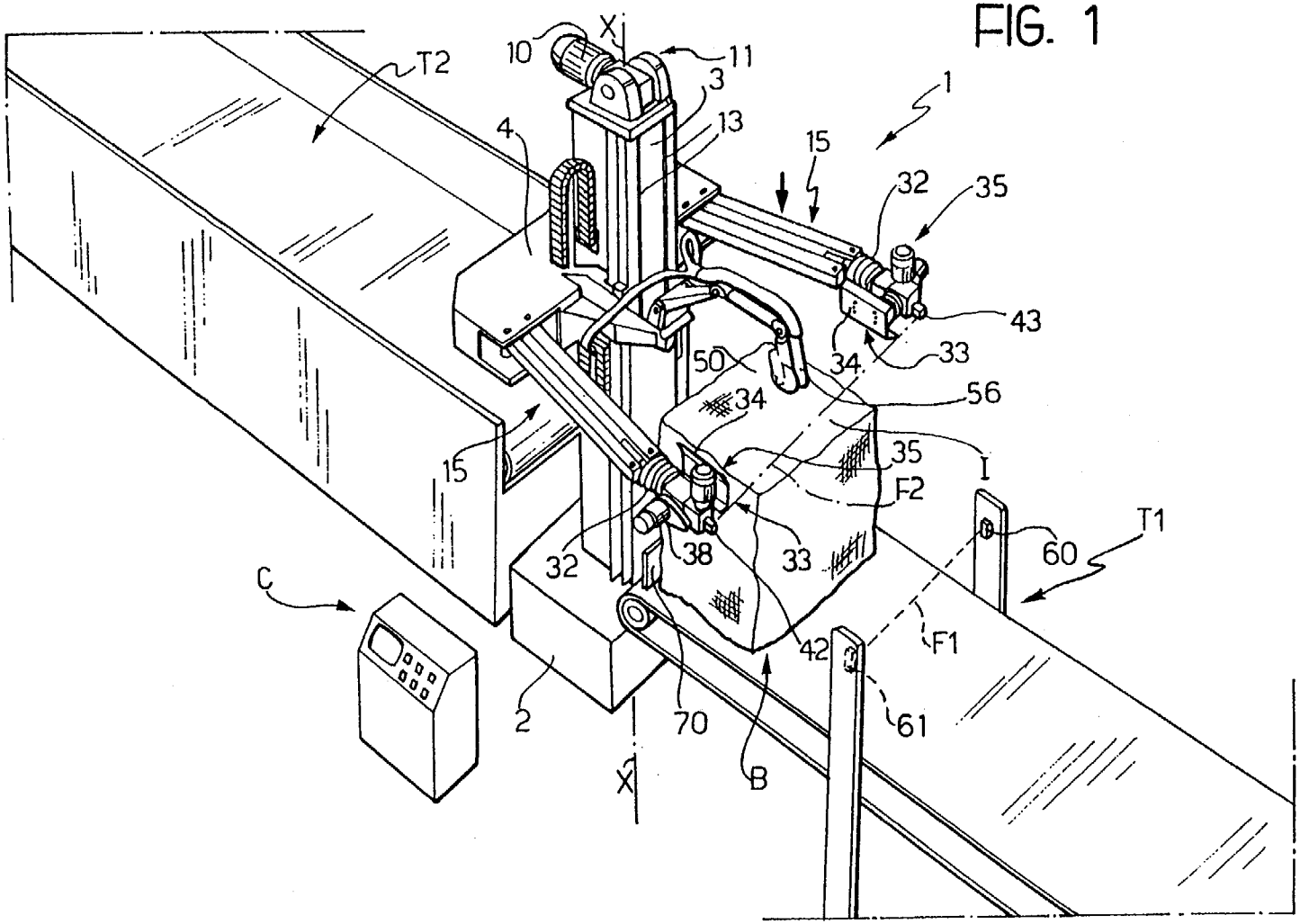

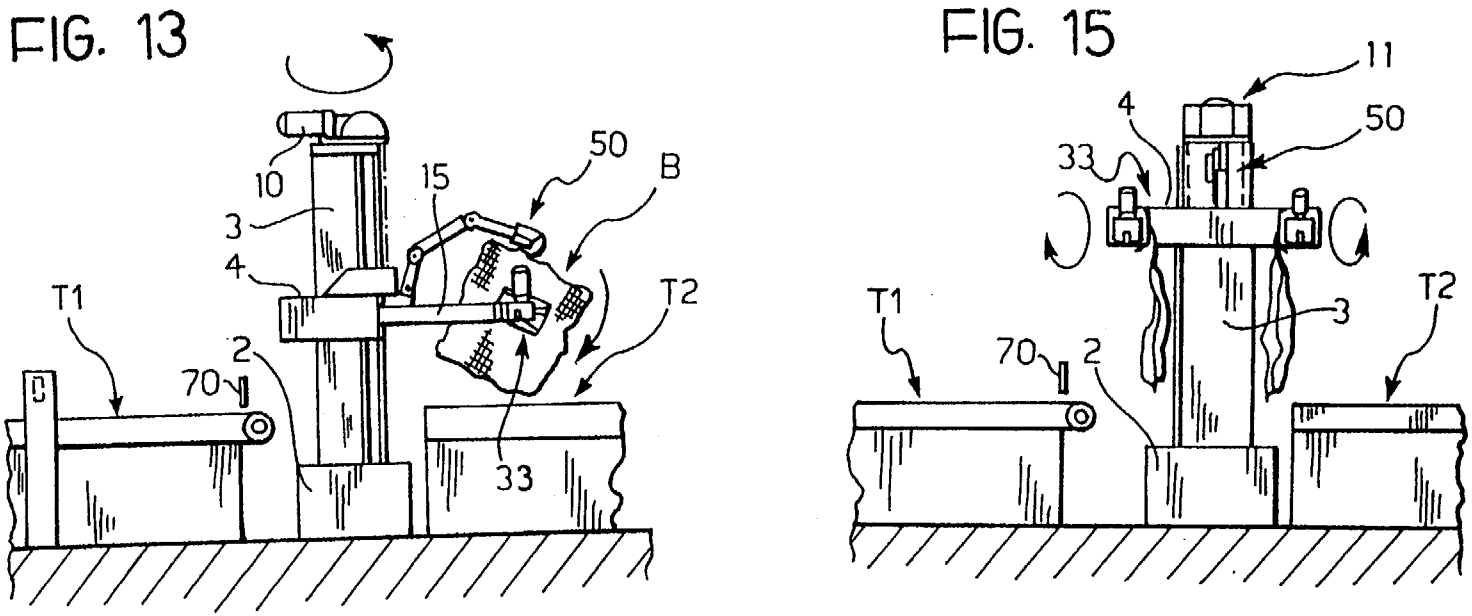
FIG. 15
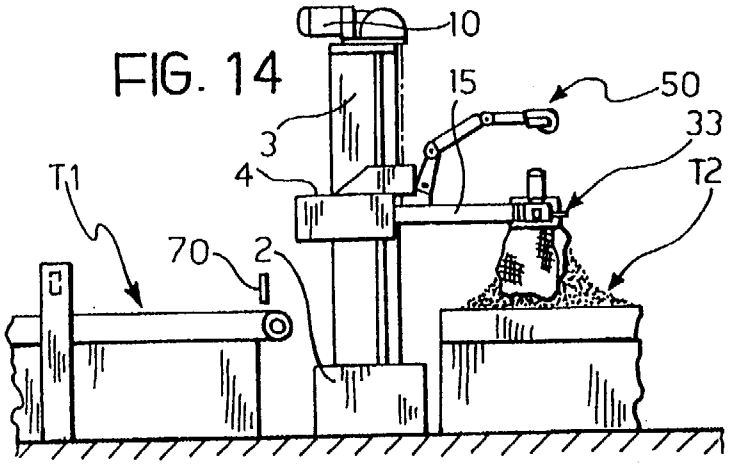
FIG. 14
FIG. 13

MACHINE FOR CUTTING AND REMOVING THE WRAPPER OF A BALE

DESCRIPTION

The present invention relates to an automatic machine for cutting and removing the wrapper of a bale, particularly a bale of tobacco.

More specifically, the invention relates to a machine comprising:

- a support structure including a vertical upright,
- a cross member carried by said support structure and movable relative to the upright,
- two arms, one end of each being articulated to the cross member and the other end having a rotatable gripping device for gripping a bale,
- motor means and associated control means for moving the cross member upwards and downwards, for moving the arms apart and towards each other, and for rotating their gripping devices, and
- cutting means for cutting the wrapper of a bale which is gripped and rotated by the gripping devices of said arms.

A machine of the type specified above is described in the Applicant's Italian patent application No. 67770-A/90.

In the machine described in this prior patent application, the cross member which carries the gripping arms is connected to one end of a rocker arm which is articulated for pivoting on the top of the upright. The other end of the rocker arm carries a counterweight. In particular, the cross member is connected to the rocker arm by means of parallelogram linkages in a manner such that it performs a rotational-translatory movement as a result of the pivoting of the rocker arm,.

The gripping arms are articulated to the cross member and can pivot relative thereto in a vertical plane.

An object of the present invention is to provide an automatic machine of the type indicated above which has a simplified and improved structure and which, in particular, is less bulky.

These and other objects are achieved, according to the invention by means of a machine characterized in that the above-mentioned cross member is movable vertically along the upright and the gripping arms can pivot relative to the cross member in a plane disposed at an angle to the vertical.

Preferably, the arms can pivot relative to the cross member in a horizontal plane.

According to a further aspect of the invention, a machine intended in particular for cutting and removing the wrappers from substantially parallelepipedal bales of variable dimensions is characterized in that the gripping arms are at least partially extensible and contractible in a controlled manner as a result of the operation of actuator means associated respectively therewith. The machine also comprises sensor means, connected to the control means, for providing electrical signals indicative of the dimensions of the side faces of a bale to be processed, which are to be engaged by the gripping devices. Conveniently, the control means are arranged to position the cross member and to bring about any change in the lengths of the gripping arms, on the basis of the signals supplied by the sensor means, in a manner such that the gripping devices can grip the bale substantially in the centres of said side faces.

Figure 2:
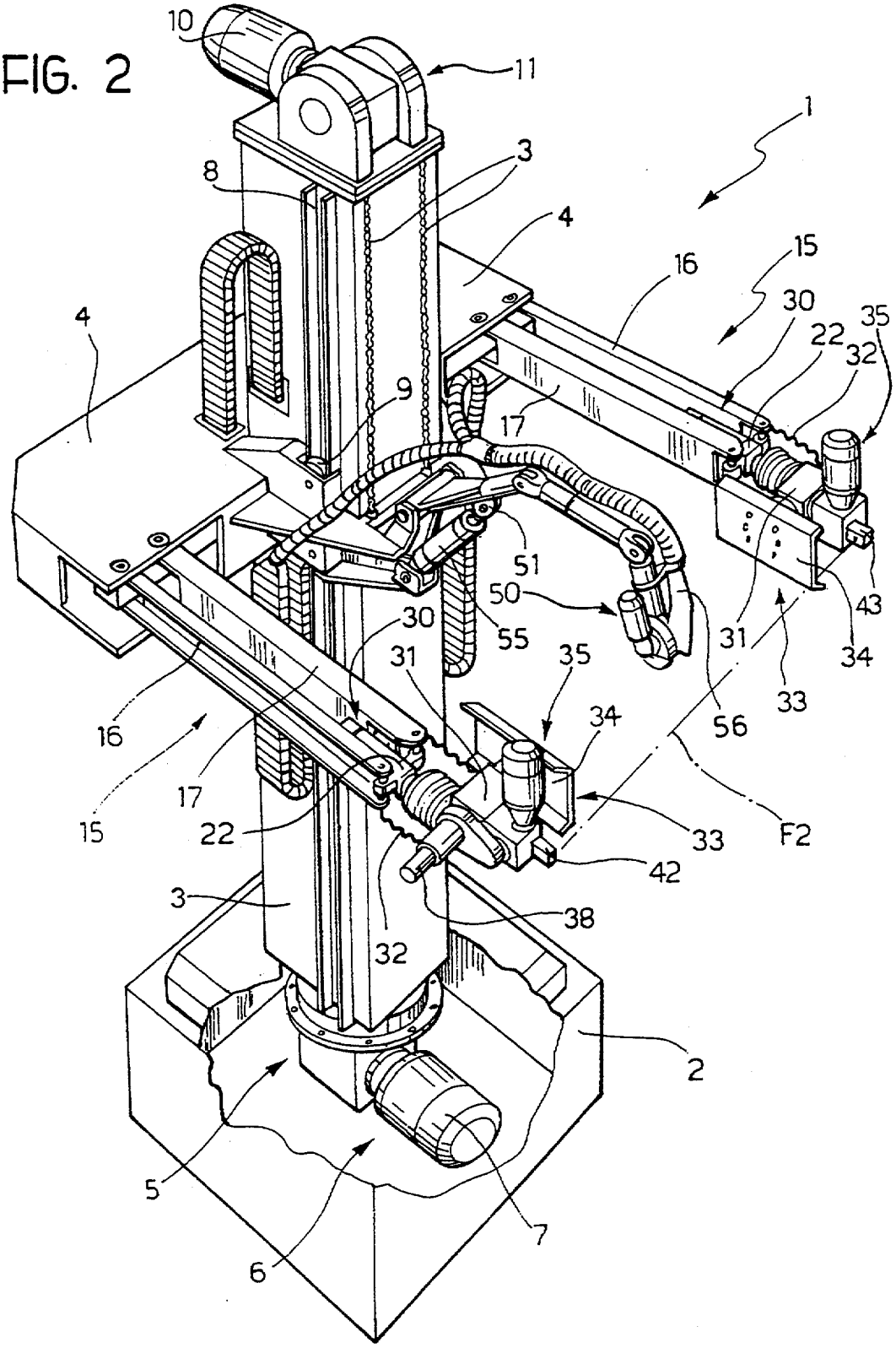
Figure 3:
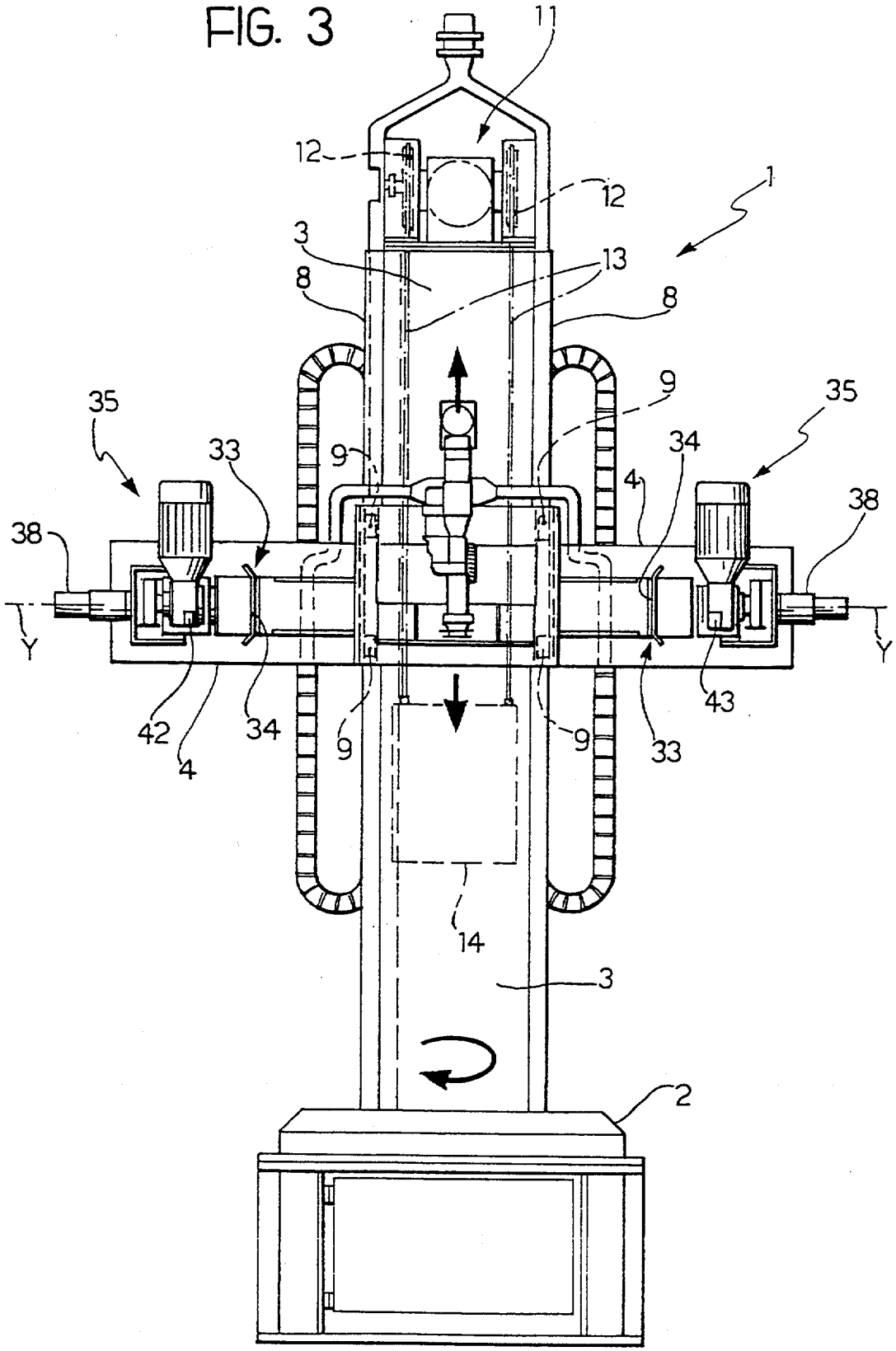
Figure 4:
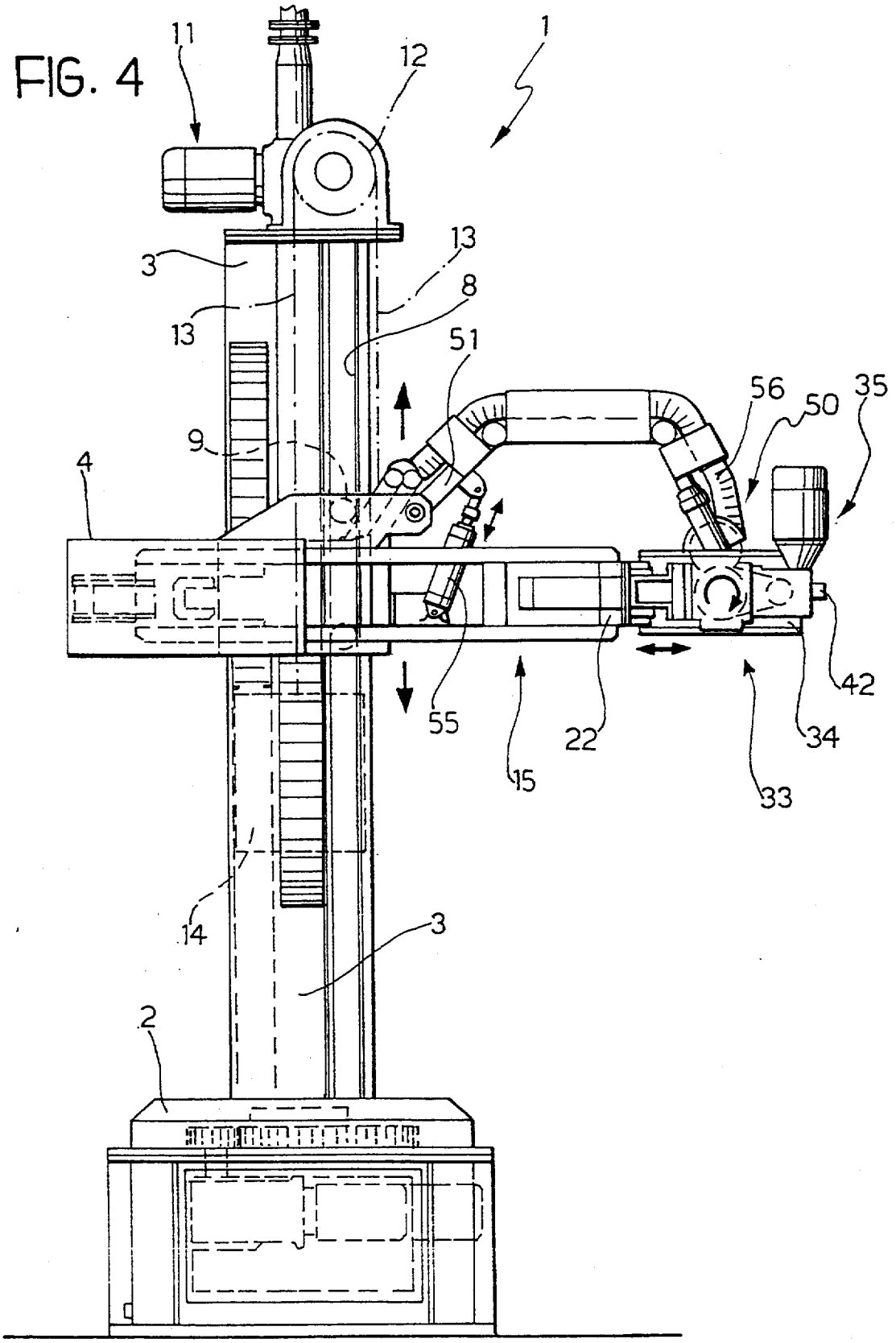
Figure 5:
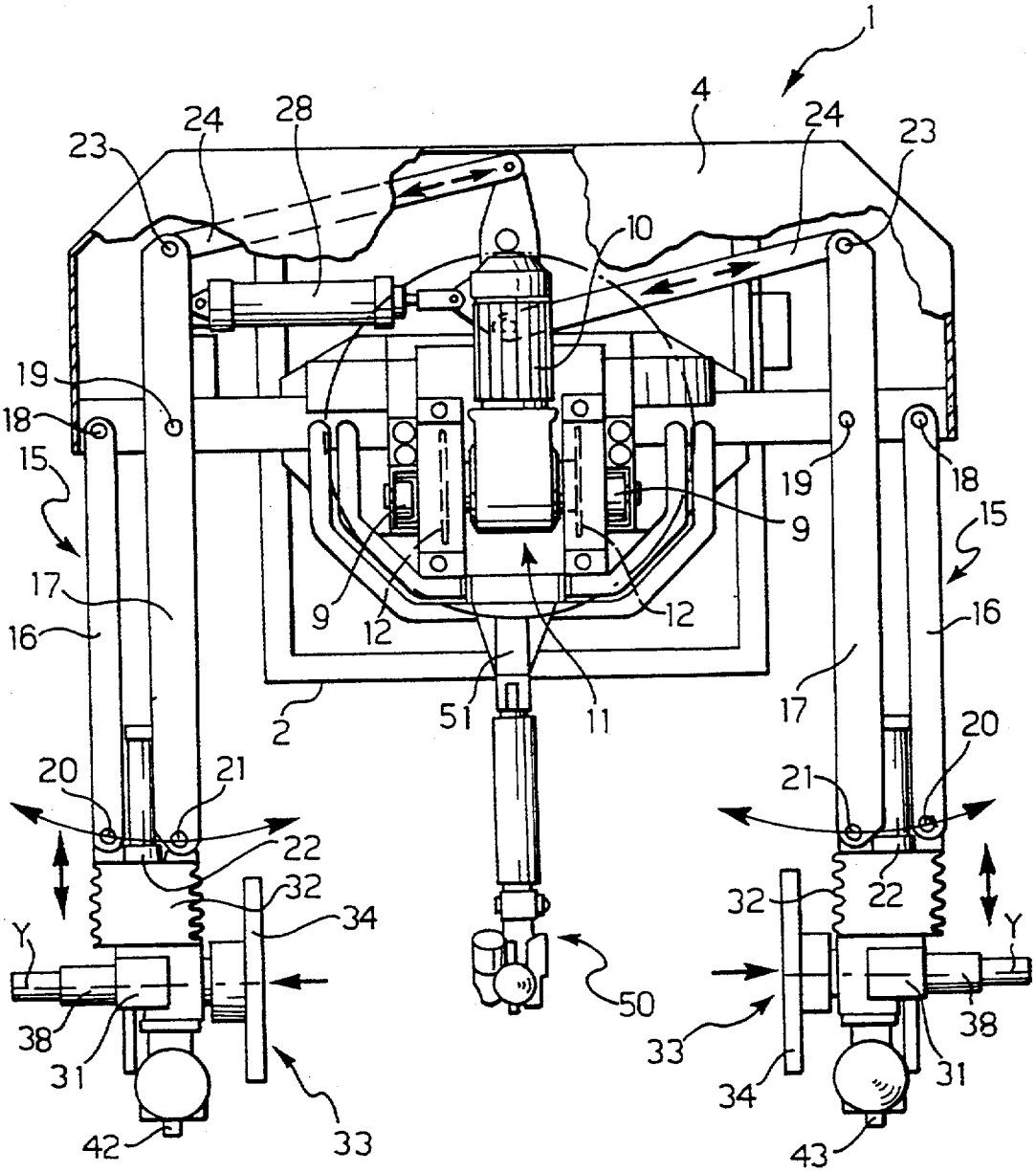
Figure 6:
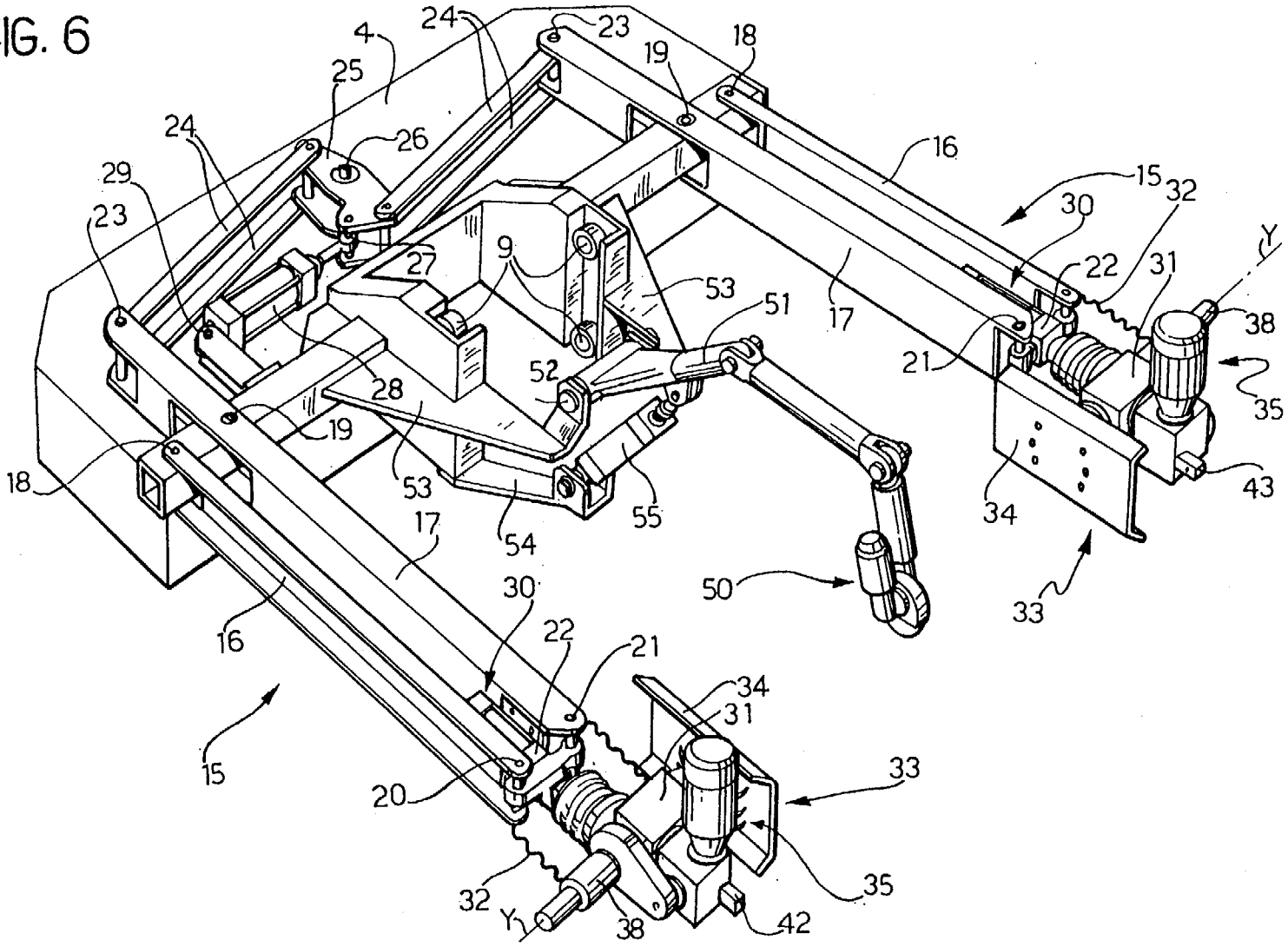
Figure 7:
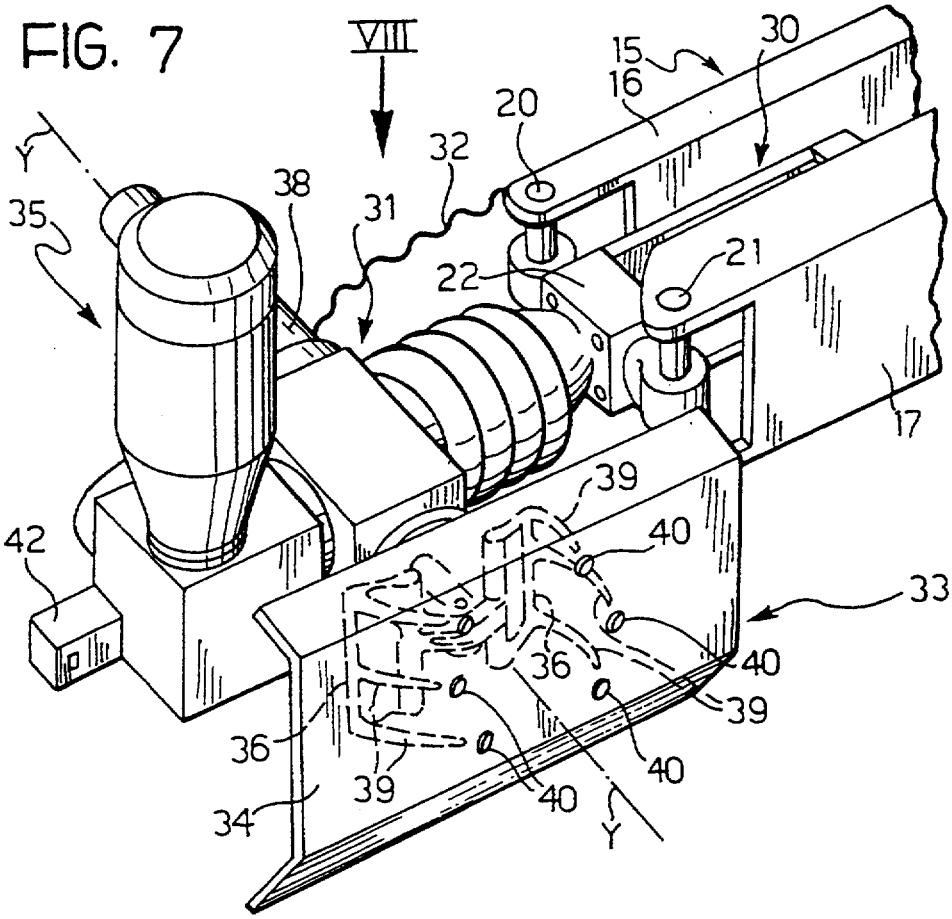
Figure 8:
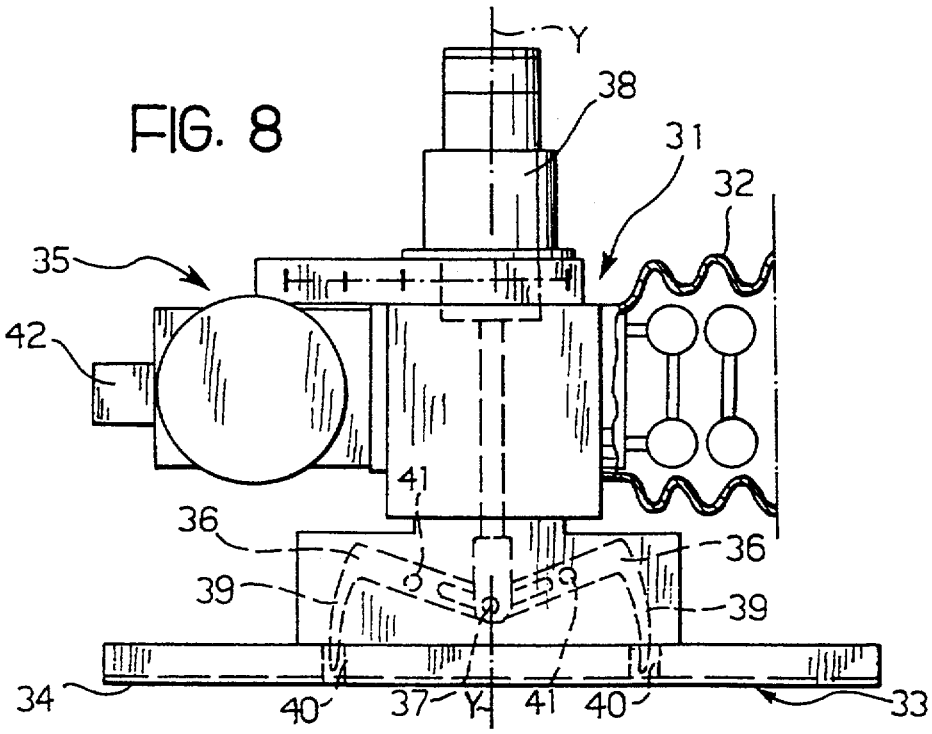
Figure 10:
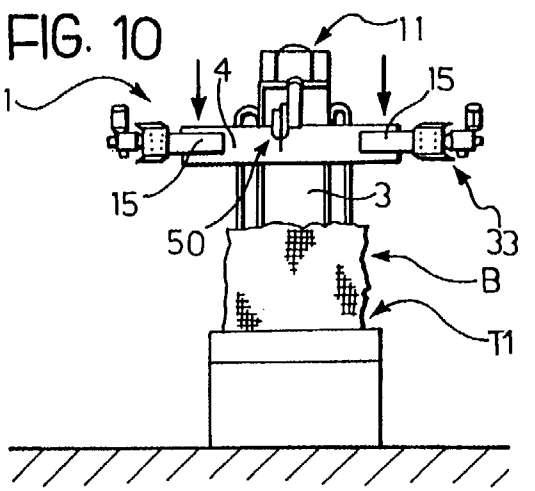

Further characteristics and advantages of the invention will become clear from the following detailed description given purely by way of non-limiting example, with reference to the appended drawings, in which:

FIG. 1 is a perspective view of a machine according to the invention,

FIG. 2 is a perspective view of the machine according to the invention, on an enlarged scale, FIGS. 3 and 4 are front and side elevational views, respectively, of the machine of FIG. 2, FIG. 5 is a plan view of the machine of FIG. 2, FIG. 6 is a perspective view of the movable cross member of the machine and of the gripping arms articulated thereto, FIG. 7 is a perspective view showing the end of a gripping arm, FIG. 8 is a plan view of one end of a gripping arm, taken on the arrow VIII of FIG. 7, and FIGS. 9 to 15 are schematic views showing the machine according to the invention at various stages of its operating cycle.

With reference to FIG. 1, an automatic machine for cutting and removing the wrapper I from a substantially parallelepipedal bale of shredded tobacco B is generally indicated 1.

The machine 1 has a base 2, an upright 3 which can rotate relative to the base about a vertical axis X—X, and a cross member 4 movable vertically along the upright 3.

The upright is supported by the base 2 with the interposition of a thrust bearing 5 (FIG. 2) and can rotate relative to the base as a result of the operation of a motor-reduction unit 6 mounted in the base. The motor-reduction unit conveniently comprises a three-phase synchronous electric motor 7 piloted by means of an inverter.

The upright 3 has two vertical guides 8 on two opposite side faces, the cross member 4 is movable vertically along the guides with the interposition of bearings 9 of the combined type (FIGS. 2–6).

The cross member 4 can be moved along the upright 3 by means of a motor-reduction unit 11 including an electric motor 10 which is supported at the top of the upright in order to rotate a pair of toothed drive and snub pulleys 12 (FIGS. 3–5) for two flexible transmission members 13, for example, chains, each connected to the cross member 4 at one end and, at the other end, to a counterweight 14 movable within the upright 3. In the embodiment shown by way of example, the chains 13 extend partially within the upright and partially outside it.

Two gripping arms, generally indicated 15, are articulated to the ends of the cross member 4.

As can be seen in FIGS. 5 and 6 in particular, each gripping arm comprises two bars 16 and 17 which are articulated to the cross member at 18 and 19 and to respective end support members 22 at 20 and 21. The bars 16, 17, the cross member, and the end support members 22 form parallelogram linkages so that, in operation, the end support members extend in a plane parallel to the cross member 4 whatever the angular positions of the arms 15.

The bars 17 extend within the cross member 4 beyond the respective articulation pins 19 and their ends which are within the cross member are articulated at 23 to the ends of respective pairs of bars 24 which in turn are articulated to the ends of a rocker arm 25 pivotable on the centre of the cross member 4 at 26.

The rocker arm is connected at 27 to the rod of a fluid operating cylinder 28 which in turn is articulated to the cross member 4 at 29.

In operation, the activation of the cylinder 28 moves the arms 15 apart or towards each other in a horizontal plane by means of the rocker arm 25 and the transmission bars 24.

In practice, the end support elements 22 of the arms 15 are constituted by the casings of two fluid cylinders 30, the rods of which are connected to an end support structure 31 of the arms.

The interconnection regions between the fluid cylinders 30 and the end support structures 31 of the arms are protected by respective annular gaiters 32 of elastomeric material.

A respective gripping device, generally indicated 33, is rotatable about a horizontal axis Y—Y in each end support structure 31 of the arms.

Each gripping device comprises a plate 34 which extends substantially perpendicular to the axis of rotation Y—Y.

The grippers 34 are rotated by respective motor-reduction units 35 supported by the end support structure 31 of each arm 15.

Each gripper 34 is associated with a respective pair of fork-like elements 36 (FIGS. 7 and 8) which are articulated at 37 to the rod of a fluid-operated cylinder 38 which is also rotatable relative to the end support structure 31 of the respective arm.

The fork-like elements 36 can pivot about respective pins 41 (FIG. 8) and have respective curved prongs 39 which can extend through corresponding through-holes 40 in the plates 34.

In operation, the operation of the fluid cylinder 38 causes the fork-like elements to move from the retracted configuration shown in FIGS. 7 and 8 to the projecting configuration in which their curved prongs extend beyond the gripper plates 34.

A radiation emitter and an associated detector fixed facing each other at the ends of the gripping arms 15 of the machine are indicated 42 and 43 respectively in FIGS. 2 and 5–8. The function of these devices will be described further below.

The machine 1 also comprises a motor-driven cutting device 50 with a blade which rotates about a horizontal axis parallel to the common axis of rotation Y—Y of the gripping devices 33.

The cutting device 50 is similar to that included in the machine according to the prior Italian patent application No. 67770-A/90 and will not therefore be described further herein.

This device is supported by the cross member 4 by means of an arm 51 which is articulated at 52 to two horizontal appendages 53 of the cross member (see FIG. 6 in particular). A fluid cylinder 55 for raising/-lowering the cutting device 50 is interposed between the arm 51 and a further appendage 54 of the cross member 4.

A suction pipe 56 disposed near the rotary blade of the cutting device (FIGS. 1, 2 and 4) communicates with a suction pump (in a manner not shown), in order to evacuate the dust and scraps produced in the course of the cutting of the wrapper of a bale of tobacco, in operation.

An electronic control unit to which the various electric motors of the machine are connected is indicated C in FIG. 1. The various operating cylinders of the machine are also connected to the control unit, by means of electro-pneumatic interfaces. The unit C is arranged to coordinate the movements and functions of all the devices which make up the machine, according to a predetermined working cycle.

A position sensor is also conveniently connected to the unit C in order to supply it with electrical signals indicative of the instantaneous position of the cross member 4 along the upright 3.

The position sensor may be constituted, for example, by a rotary encoder associated, for example, with the snub pulleys 12 which are driven by the electric motor 10, or associated with another member which is rotated as a result of the operation of the motor.

The emitter and detector devices 42 and 43 carried by the ends of the gripping arms 15 are also connected to the control unit C.

The machine described above may advantageously be installed near the end of a belt conveyor T1 (FIGS. 1 and 9–15) on which the bales B advance, wrapped in their respective wrappers.

The movements of the belt conveyor T1 are also coordinated by the control unit C.

Conveniently, a radiation emitter 60 and an associated detector 61 are disposed near the supply conveyor T1 (FIG. 1) facing each other on opposite sides of the path of the bales B. The devices 60 and 61 are disposed in a manner such that each bale which is transferred towards the machine 1 oriented with two side faces substantially parallel to the direction of transportation intersects the beam of radiation F1 (FIG. 1) directed by the emitter 60 towards the associated detector 61.

On the basis of the data supplied by the devices 60 and 61, the control unit C can thus determine the widths of the side faces of the bale B parallel to the direction of transportation.

These data are useful for positioning the gripping devices 33 of the machine in the centres of the side faces of the bale which is to be gripped by the devices, as will be described further below.

The machine described above operates in the manner which will now be described with particular reference to FIGS. 9 to 15.

Figure 9:
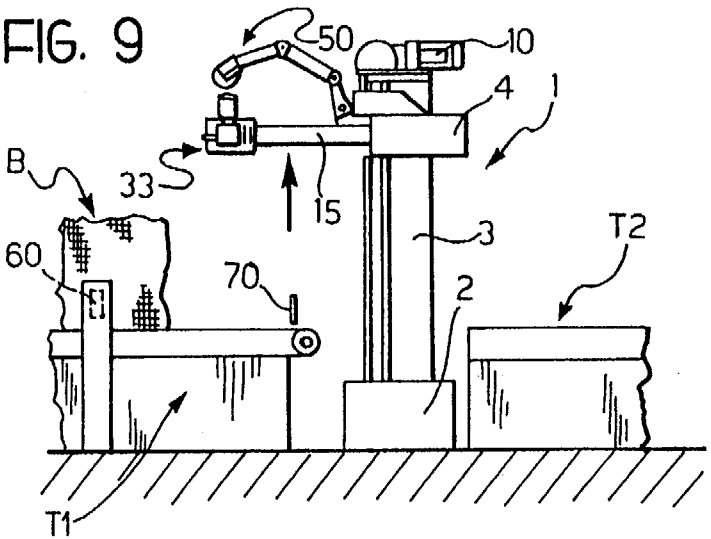

The conveyor T1 brings a bale B up to the machine, as shown in FIGS. 1 and 9. The control unit C detects the widths of the side faces of the bale by means of the devices 60 and 61.

The bale B stops in a working position defined, for example, by a stop member indicated 70 in FIGS. 1 and 9.

In this situation, the cross member 4 is raised and the gripping arms 15 are spaced apart.

The control unit C then moves the cross member 4 downwards, by means of the electric motor 10. During its descent, the radiation beam F2 (FIG. 1) between the devices 42 and 43 carried by the arms 15 intersects the top of the bale B. This enables the control unit C to measure the height of the bale B and to position the gripping devices 33 of the arms 15 in the centres of the side faces of the bale B which are to be gripped by the devices.

The vertical centering is achieved by stopping the descent of the cross member 4 when the gripping devices are half way up the bale. Any breadthwise centering is achieved by extending or contracting the ends of the gripping arms by the operation of the fluid cylinders 30.

Figure 11:
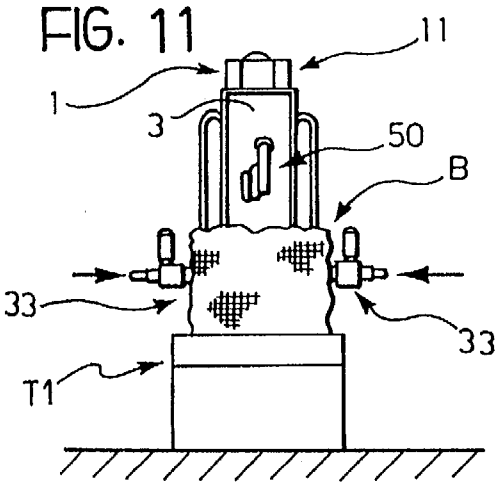

The unit C then moves the arms 15 towards each other in order to grip the bale B, as indicated in FIG. 11.

The fork-like elements 36 of the gripping devices are moved to their projecting positions by means of the cylinders 38. Their curved prongs thus easily penetrate the wrapper of the bale.

Figure 12:
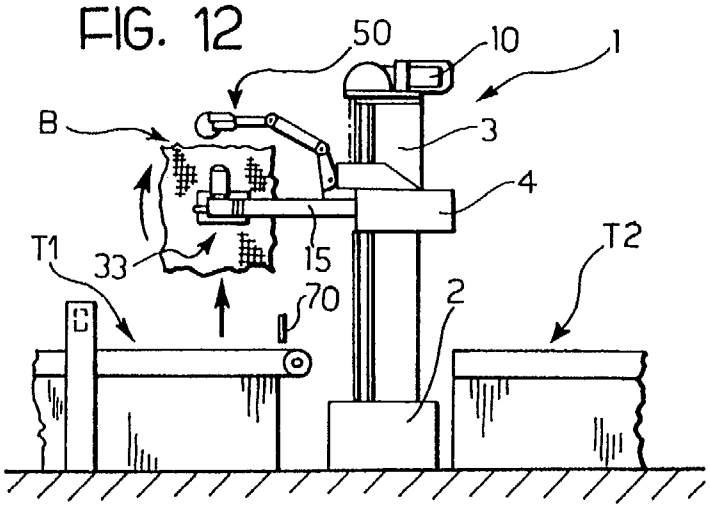

The cross member 4 is then raised, as shown in FIG. 12, and the cutting device 50 is lowered. The motor-reduction units 35 at the ends of the arms are then operated in order to rotate the bale B about the axis Y—Y by means of the gripping devices 33.

During this rotation, the cutting device divides the wrapper I of the bale B into two separate portions. Simultaneously with the cutting of the wrapper, the upright 3 is rotated through 180° relative to the base 2 (FIG. 13), so as to bring the bale being cut above an output conveyor T2. Upon completion of the rotation of the bale B and the cutting of its wrapper, as shown in FIG. 14, the tobacco forming the bale is deposited on the conveyor T2 whilst the two portions of the wrapper continue to be held by the fork-like members 36 of the gripping devices 33. The release of the tobacco may be facilitated at this stage by a pulsed opening and closing movement of the arms 15. The tobacco released is then moved away as a result of the operation of the conveyor T2.

The arms 15 are moved towards each other and, at the same time, the unit C rotates the upright 3 relative to the base 2, for example, through 90° in the opposite sense to the previous rotation, so as to bring the machine to the position shown in FIG. 15. In this position, the grippers 33 are rotated, for example, through about 360° whilst their prong-like gripping members 39 are rectracted. The two portions of the wrapper I of the bale can then fall to the ground.

At this point, the control unit C rotates the upright 3 through a further 90° relative to the base 2 and raises the cross member 4 so as to return the machine to the configuration of FIG. 1 in order to process a further bale B transferred to the machine by the conveyor belt T1.

The machine described above has a relatively simple and compact structure. Moreover, the machine is suitable for processing bales of tobacco of generally parallelepipedal shape with dimensions which may vary in a programmed or random manner. In any case, the machine can ensure that the bale is gripped in the centres of its side faces by virtue of the devices which determine the widths and the heights of the side faces of the bales supplied thereto.

Naturally, the principle of the invention remaining the same, the forms of embodiment and details of construction may be varied widely with respect to those described and illustrated purely by way of non-limiting example, without thereby departing from the scope of the present invention.

What is claimed is:

1. An automatic machine for cutting and removing the wrapper of a bale, particularly a bale of tobacco, comprising:

a support structure including a vertical upright, a cross member carried by said support structure and movable relative to the upright, two arms, one end of each of which is articulated to the cross member, a rotatable gripping device at the other end of each arm for gripping a bale, associated motor means and control means for moving the cross member upwards and downwards, for moving the arms apart and towards each other, and for rotating their gripping devices, and cutting means for cutting the wrapper of a bale which is gripped and rotated by the gripping devices of said arms, wherein the cross member of the machine is movable vertically along said upright and the above mentioned arms can pivot relative to the cross member in a plane disposed at an angle to the vertical.

2. A machine according to claim 1, wherein said arms can pivot relative to the cross member in a horizontal plane.

3. A machine according to claim 1, wherein it includes at least one flexible transmission member connected at one end to the cross member, a counterweight connected to the other end of the at least one flexible transmission member and movable vertically along the upright, and at least one drive and snub pulley for the at least one flexible transmission member, and wherein said motor means comprise an electric motor carried by the upright arid coupled to the at least one drive and snub pulley.

4. A machine according to claim 1, particularly but not exclusively for use for cutting and removing the wrappers of substantially parallelepipedal bales of variable dimensions, wherein respective actuator means are associated with the arms and said arms are at least partially extensible and contratable in a controlled manner as a result of the operation of their respective actuator means, the machine also comprising sensor means connected to said control means, for providing electrical signals indicative of the dimensions of those side faces of a bale to be processed, which are to be engaged by the gripping devices, and wherein the control means are arranged to position the cross mender and to bring about any change in the lengths of said arms, on the basis of the signals supplied by said d sensor means, in a manner such that the gripping devices can grip the bale substantially in the centre of said side faces.

5. A machine according to claim 4, to which the bales are supplied in succession, oriented with said side faces substantially parallel to the direction of transportation by means of conveyor means in use, wherein said sensor means of the machine comprise a radiation emitter and an associated detector which face each other on opposite sides of the path of the bales in a manner such that each bale can intercept the radiation directed by the emitter towards the associated detector, in use.

6. A machine according to claim 4, wherein it also comprises position sensor means for supplying the control means with electrical signals indicative of the instantaneous position of the cross men, her relative to the upright, a radiation emitter connected to one of the arms, and a detector carried by the other arm to face the emitter, said control means being arranged, upon commencement of the processing of a bale positioned on a reference plane near the machine, to move the cross member along the upright with the arms spaced apart by a distance greater than the maximum width of the bales, in a manner such that the path of the radiation emitted by the emitter associated with one arm towards the detector associated with the other arm intersects the top of said bale.

7. A machine according to claim 6, wherein the position sensor means of the cross member comprise a rotary encoder associated with the electric motor carried by the upright.

8. A machine according to claim 1, wherein suction means are associated with the cutting means for removing dust and scraps produced in the course of the cutting operation.

* * * * *